US005981917A

United States Patent [19]

Groth et al.

[11] Patent Number: 5,981,917

[45] Date of Patent: Nov. 9, 1999

[54] LADLE PREHEAT INDICATION SYSTEM

[75] Inventors: Richard J. Groth; Roberto Bandelli, both of Pittsburgh, Pa.

[73] Assignee: USX Corporation, Pittsburgh, Pa.

[21] Appl. No.: 09/146,778

[22] Filed: Sep. 4, 1998

[51] Int. Cl.[6] ..... H05B 1/02

[52] U.S. Cl. ..... 219/497; 219/492; 219/497; 219/421; 219/425; 374/107; 266/242; 266/44

[58] Field of Search ..... 219/492, 494, 219/497, 501, 505, 506, 508, 420, 421, 425; 374/125, 120–123, 130, 102, 107; 266/44, 46, 141, 901, 242

[56] References Cited

U.S. PATENT DOCUMENTS

| | | | |
|---|---|---|---|
| 3,907,260 | 9/1975 | Leatherby . | |
| 4,014,532 | 3/1977 | Holey . | |
| 4,086,805 | 5/1978 | Kinderling et al. | 324/102 |
| 4,223,873 | 9/1980 | Battles . | |
| 4,229,211 | 10/1980 | Battles . | |
| 4,359,209 | 11/1982 | Johns . | |
| 4,394,566 | 7/1983 | Magnusson . | |
| 4,462,698 | 7/1984 | Ely . | |
| 4,718,643 | 1/1988 | Gitman . | |
| 4,870,235 | 9/1989 | Steers et al. | 99/325 |
| 5,249,866 | 10/1993 | Dube et al. | 374/178 |
| 5,364,185 | 11/1994 | VanZandt et al. | 374/28 |

*Primary Examiner*—Mark Paschall
*Attorney, Agent, or Firm*—William F. Riesmeyer, III

[57] ABSTRACT

A ladle preheating system and method in which heat input rate to the ladle is calculated and monitored throughout the preheating period, calculating the moving average slope representing change over time of the rate of change of heat input, correcting the moving average slope for unavoidable variations in the measurements of the heat input rate, calculating the change of the moving average slope over time (the approximate second derivative), and signaling to an operator the readiness of the ladle based upon this second derivative's falling below a preset criteria indicating a fully preheated ladle.

19 Claims, 7 Drawing Sheets

LADLE PREHEAT INDICATION SYSTEM

BACKGROUND

1. Field of the Invention

This invention relates to the preheating of refractory-lined ladles for containing and transporting molten metal and, more particularly, to a system and method for monitoring the heat content of a ladle during preheating and indicating accurately when the ladle refractories are uniformly heated throughout, and particularly to such a system and method in which it is determined when the ladle is so heated by measuring the slope of the heat input rate (or the fuel flow rate) over time and, especially, the second derivative of a variation-corrected rate of change of heat input rate to the ladle.

2. Description of the Prior Art

In a steelmaking shop, brick or cast refractory-lined ladles are used to transport liquid steel from a steelmaking furnace to a treatment section of the shop or to a forming operation such as continuous casting. In the latter case, it is necessary that the casting operation be carried out continuously, so several ladles may rotate through the shop simultaneously. The thermal state of the ladle has a direct and significant impact on heating of the ladle and also on liquid steel temperature loss during transport of the ladle from the steelmaking furnace to secondary steelmaking processes and to a continuous caster.

Such ladles may heat up when filled with liquid metal because of the heat absorbed from the melt by the ladle refractory lining. On the other hand, the ladles cool off when empty. The length of time during which a ladle is empty is highly variable and unpredictable. For example, delays due to a major ladle repair taking many hours to complete may result in a very cool ladle which, if used in that condition, will cause relatively high loss of the liquid metal temperature. In continuous casting operations, liquid steel, as introduced into the caster tundish, may be only about 40° F. above the metal liquidus temperature. In such case, one cannot afford to lose significant and unanticipated heat to the ladle.

On the other hand, over-heating of a ladle is inefficient and costly and may result in increased refractory damage.

Accordingly, ladle preheating is an important common practice in the metals manufacturing field, and serves to normalize heat losses for ladles taken out of the rotational use cycle for repair and for ladles first introduced into the use cycle, and to minimize thermal stresses in the ladle refractory due to pouring hot liquid metal into a cool refractory lining.

Usually a gas-fired burner is used to inject a flame into the interior of the ladle, for example when the ladle is positioned on its side on a horizontal preheating stand. Gas-fired ladle preheaters are represented, for example, by U.S. Pat. Nos. 4,359,209; 4,229,211; 4,014,532, and 3,907,260. Heating a ladle with electrical power also is known, for example as shown in U.S. Pat. No. 4,394,566.

FIG. 1 of the present application illustrates a typical prior art method of changing fuel gas flow to a ladle preheater in respect to control temperature (actual ladle refractory hot face temperature as measured by a thermocouple in the ladle) and set point temperature (predetermined desired ladle hot face temperature). As indicated by FIG. 1, it is usual to use a maximum fuel flow rate during an initial preheating time period when the ladle is relatively cool, then gradually to decrease fuel flow rate after the set point temperature is reached and until the ladle is fully heated. A typical time for control temperature to reach the set point temperature is about 2 hours, and a typical time to reach a fully heated condition of the ladle refractory is about 20 hours, as also indicated in FIG. 1.

Currently, control of a ladle preheater usually is based on feedback from a thermocouple located in the preheater lid. This thermocouple measures the average hot face temperature of the ladle refractory. Initially, when the ladle first is placed on the preheater, the burner fires at maximum capacity to input heat as rapidly as possible. As the hot face temperature approaches the set point temperature, the burner is throttled back so that the set point temperature is maintained and not overshot. That is, as the ladle hot face approaches the set point temperature, the fuel flow rate is reduced so that the rate of heat input matches the rate at which heat is being absorbed into the refractory, as shown in FIG. 1.

Practically, fuel flow rate can be considered to be equivalent to the heat input rate to a ladle during preheating. The principal difference is that some heat from the burning fuel, e.g. natural gas, is lost, primarily to off-gases (flue gases). Thus, heat input rate is a somewhat more accurate measure of ladle heat content than is gas flow rate.

Exemplary of such prior art, U.S. Pat. No. 1,512,008 discloses methods and apparatus for maintaining working temperature, in, e.g. an electrically-heated furnace, by varying the rate of heat input rapidly in response to wide variations in thermocouple-determined furnace temperature, for example, by quickly raising the temperature near a desired level, then varying the heat input rate slowly as the temperature nears the desired value.

U.S. Pat. No. 4,223,873 discloses a direct flame ladle preheating system including a control circuit to maintain combustion gases at a predetermined temperature and to adjust fuel-air ratio in order to maximize combustion and minimize oxygen remaining in the combustion gases.

U.S. Pat. No. 4,718,643 relates to ladle preheating in which flow of fuel and oxygen is controlled responsive to ladle temperature to increase heat input during an initial preheating phase and to insure maximum system efficiency during a soaking phase.

U.S. Pat. No. 4,462,698 relates to ladle preheating in which a radiation pyrometer is used to measure the (hot face) ladle refractory for control of gas flow rate.

Such prior art methods are appropriate for controlling the surface temperature of the ladle refractory during preheating, but they do not indicate when a preheated ladle has absorbed enough heat so that the temperature losses of the liquid metal will be consistent and controllable. Thus these earlier practices fall short of indicating ladle readiness for use after preheating because the temperature distribution within the ladle lining thickness is unsteady due to a cyclic heat input (e.g. when liquid steel is poured into the ladle) and cooling periods (e.g. when the ladle is empty). For example, when a ladle is full of liquid steel, the refractory is exposed to a heat source of high temperature, e.g. about 2800–3000° F. in contact with and moving against the inside surface of the refractory lining of the ladle. After casting or pouring the liquid steel out of the ladle, the empty ladle is exposed to the atmosphere for a significant period of time during which the inside surface of the refractory lining cools, typically to about 1400° F. or less. Further unpredictable variables, such as ambient temperature and wind conditions in the steelmaking shop, significantly affect ladle refractory and shell temperatures. These thermal variables are not taken into account by such prior art practices. The same is true of changes in refractory thickness over the course of several use cycles, due to erosion of the refractory, which causes a loss in insulating capacity and hence a change in heat capacity of the ladle and the rate of heat input during preheating.

Measuring the temperature of the steel shell of the ladle also does not provide an effective way of measuring or controlling the rate of heat input to the ladle. For example, a ladle, recycled, say 1½ hours after casting its contents, may be put on a preheater because it is considered to be too cold. The inside surface of the refractory lining may be about 1200° F. and the working lining (the lining next to a bath of liquid metal and underlain with a thinner safety lining) may have lost a significant amount of heat, but the shell temperature may be about 650° F.—which would indicate that the ladle is ready for service—but in fact the ladle is cold and, if used in this condition, will cause significant heat loss from the liquid metal. Thus, similarly to ladle hot face temperature, ladle shell temperature will not reliably indicate overall thermal conditions of the ladle refractories.

A practical monitoring and signalling system is needed for more accurately indicating to an operator when a preheated ladle is ready for service, i.e. when the ladle is heat soaked throughout the refractory lining and thus is hot enough to guarantee minimum and consistent heat loss from the molten metal.

SUMMARY OF THE INVENTION

The present invention provides apparatus and method for monitoring the heat content of a ladle refractory lining during preheating of the ladle by generating data on gas flow rate and combustion air flow rate (for a gas-fired preheater), actual control temperature (of the refractory hot face), and set point (desired aim) temperature. These data are used to perform a logical comparison between the control and set point temperatures, e.g. by a programmable logic controller (PLC). As long as the control temperature is less than the set point temperature, an appropriate signal may be generated indicating that the ladle is not yet ready for service, and calculation is begun of the rate of change of heat input rate to the ladle refractory (the first derivative of the heat input rate). Subsequently, a calculation is performed of the approximate second derivative of the heat input rate, i.e. how the rate of change of heat input rate changes over time. When the second derivative of the maximum slope of the rate of change of heat input rate—which is the average (or moving average) slope corrected for unavoidable variations—reaches a preset level indicating that the rate of heat absorption by the ladle refractories is at or near zero, i,e. that the ladle is soaked and the heat content is at a maximum steady state, a signal is generated indicating that the ladle is fully preheated throughout the refractory thickness and is ready for service.

DESCRIPTION OF PREFERRED EMBODIMENTS

Figure 2:
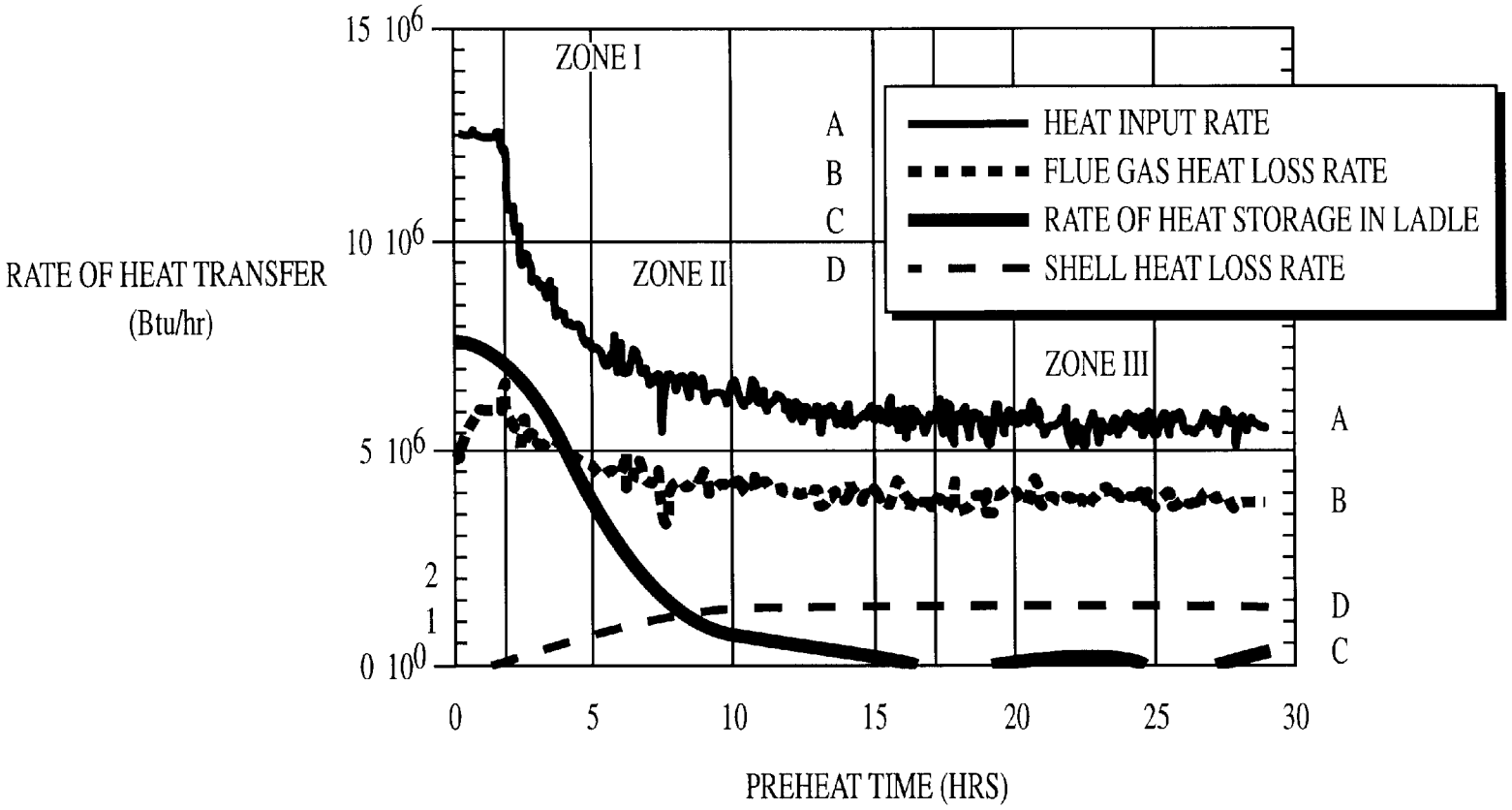
FIG. 2 comprises graphs of changing heat input rate (graph A), flue gas heat loss rate (graph B), rate of heat storage in the ladle (graph C), and ladle shell heat loss rate (graph D), vs. time.

The general relationship for heat transfer, BTU/hr, in ladle preheating, as shown in FIG. 2, is given by the following equation:

$$q_{in}=q_{flue}+q_{shell}+q_{storage} \qquad \text{Equation 1}$$

where:

$q_{in}$=rate of heat input (fuel flow rate) Curve A $q_{flue}$=rate of heat loss in flue gases Curve B $q_{shell}$=rate of heat loss from ladle shell Curve D $q_{storage}$=rate of heat storage in ladle refractory Curve C The relative amount of each of these quantities in the heat balance during the preheat period is given in FIG. 2, showing that, when the ladle first is placed on the preheater (heating zone I), the rate of heat input (graph A) is kept at a constant high value. Thus, in this condition, when the control temperature is less than the set point temperature, a comparison of the control temperature and the set point temperature is made and, as long as the control temperature is less than the set point temperature, a fuel flow rate controller will function to demand maximum fuel flow in order to maintain such constant value. In this part of the ladle heat-up, the rate of heat absorption in the ladle refractory is high, and at the other extreme, after a long time on preheat, when steady-state conditions are reached (the ladle is soaked and the rate of heat absorption in the ladle is negligible) and the rate of heat input is a constant (graph A-heating zone III), the value of which depends upon refractory type, refractory wear, ambient conditions and the initial thermal state of the ladle. Thus:

$$q_{storage}=0 \text{ (steady state)} \qquad \text{Equation 2A}$$

$$q_{flue} \text{ and } q_{shell}=\text{constant} \qquad \text{Equation 2B}$$

$$q_{in} \text{ (fuel flow rate)}=\text{constant} \qquad \text{Equation 2C}$$

Before soak conditions are achieved, but after the set point temperature is reached (heating zone II of FIG. 2), the temperature of the flue gas (FIG. 2, graph B) becomes a constant so that the amount of heat lost from the flue gas now is in direct proportion to the fuel gas input rate, i.e. the heat input rate (graph A). The amount of heat loss in the flue gas is much greater than the losses from the ladle shell (FIG. 2, graph D), so that the change in fuel gas flow rate is proportional to the change in the rate of heat storage in the ladle (FIG. 2, graph C).

$$\frac{d\,q_{storage}}{d\,t} \text{ is proportional to } \frac{d\,q_{in}}{d\,t} \qquad \text{Equation 3}$$

Therefore, as the ladle refractory absorbs heat and approaches steady state ($q_{storage}$=or greater than 0) after the set point temperature is reached, the rate of change in the fuel input rate tends toward zero.

$$q_{storage} \text{ approaches 0 and } \frac{dq_{in}}{} \text{ approaches 0}$$

The rate of change of the fuel flow rate is indicative of how much heat the ladle can absorb, and as this factor tends toward zero, the ability of the refractory to absorb additional heat also tends toward zero and, therefore, the ladle is soaked and ready for service. Tests, using a number of thermocouple embedded in the ladle refractory, were conducted confirming the relationship between the rate of change of heat input rate and the change in refractory heat content. In each such test, as the fuel flow rate tended toward a constant, the measured refractory temperature (control temperature) also tended toward a constant, steady-state condition.

The present invention is based on determining the rate of change of the heat input rate (the slope of a graph showing the change of heat input rate or fuel flow rate change over time) of a linear regression of sampled data. For such purpose, the graph of the heat input rate (fuel flow rate) is divided into time increments, as shown, for example, at A, B, C, D of FIG. 1, and the average slope of the graph of changing heat input (or gas flow) rate is determined according to the following equations:

Moving Average Slope (CFH/fractional time period) = Equation 4A $$\frac{n\sum_{i=1}^{n} x_i y_i - \sum_{i=1}^{n} x_i \sum_{i=1}^{n} y_i}{n\sum_{i=1}^{n} x_i^2 - \sum_{i=1}^{n} x_i^2}$$

$$L = \sum_{i=1}^{n} x_i \qquad \text{Equation 4B}$$

where:

L=length of time period n=number of measurements in time period L $y_i$=calculated rate of heat transfer to the ladle, which is a function of fuel gas flow rate, air flow rate (cubic feet per hour, CFH) and control temperature.

i=a unit time period within time L $x_i$=fraction of time period, i

Figure 3:
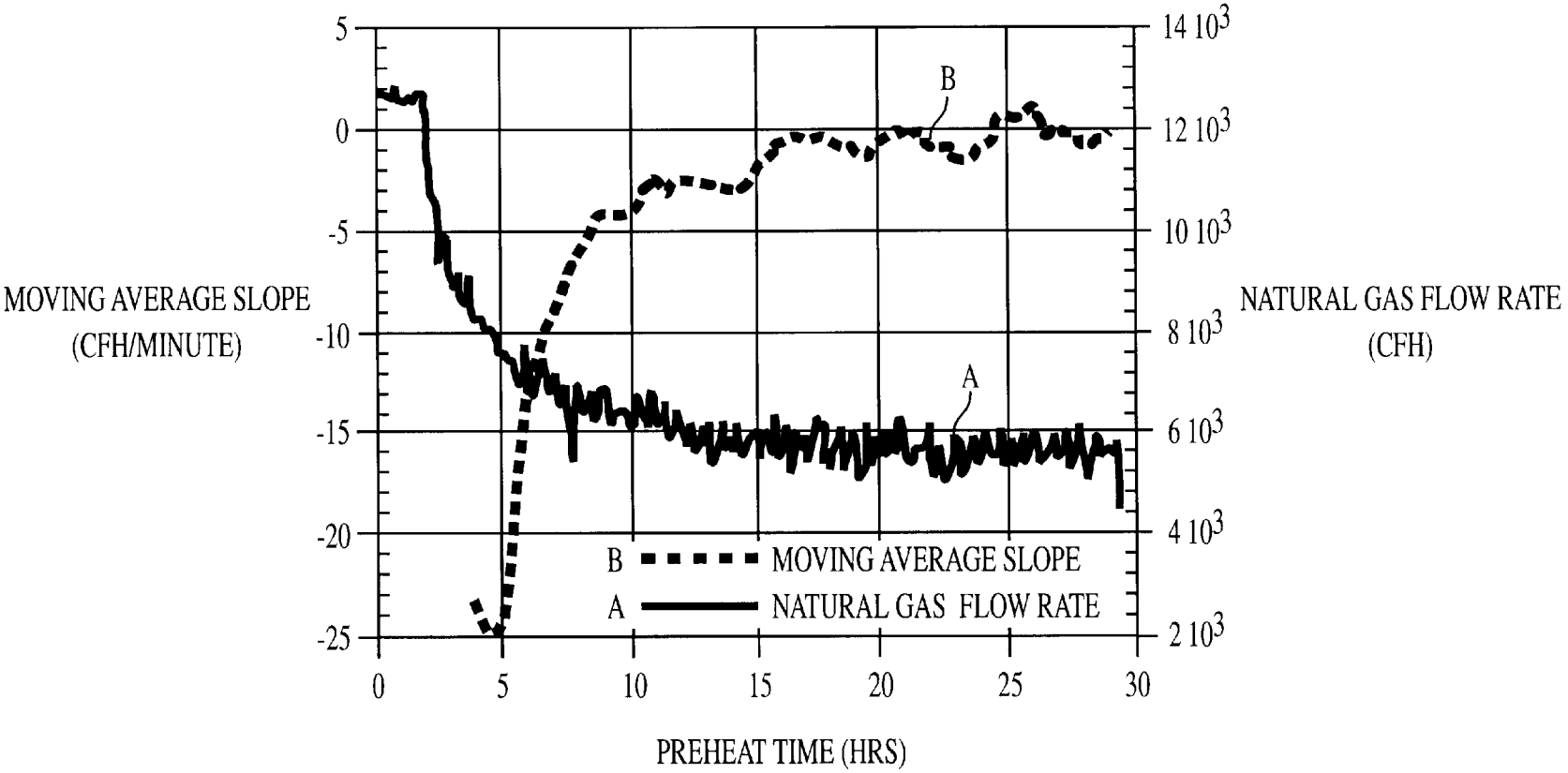
FIG. 3 comprises graphs showing change of fuel gas flow rate (graph A) and moving average slope (graph B) vs. time.
Figure 4:
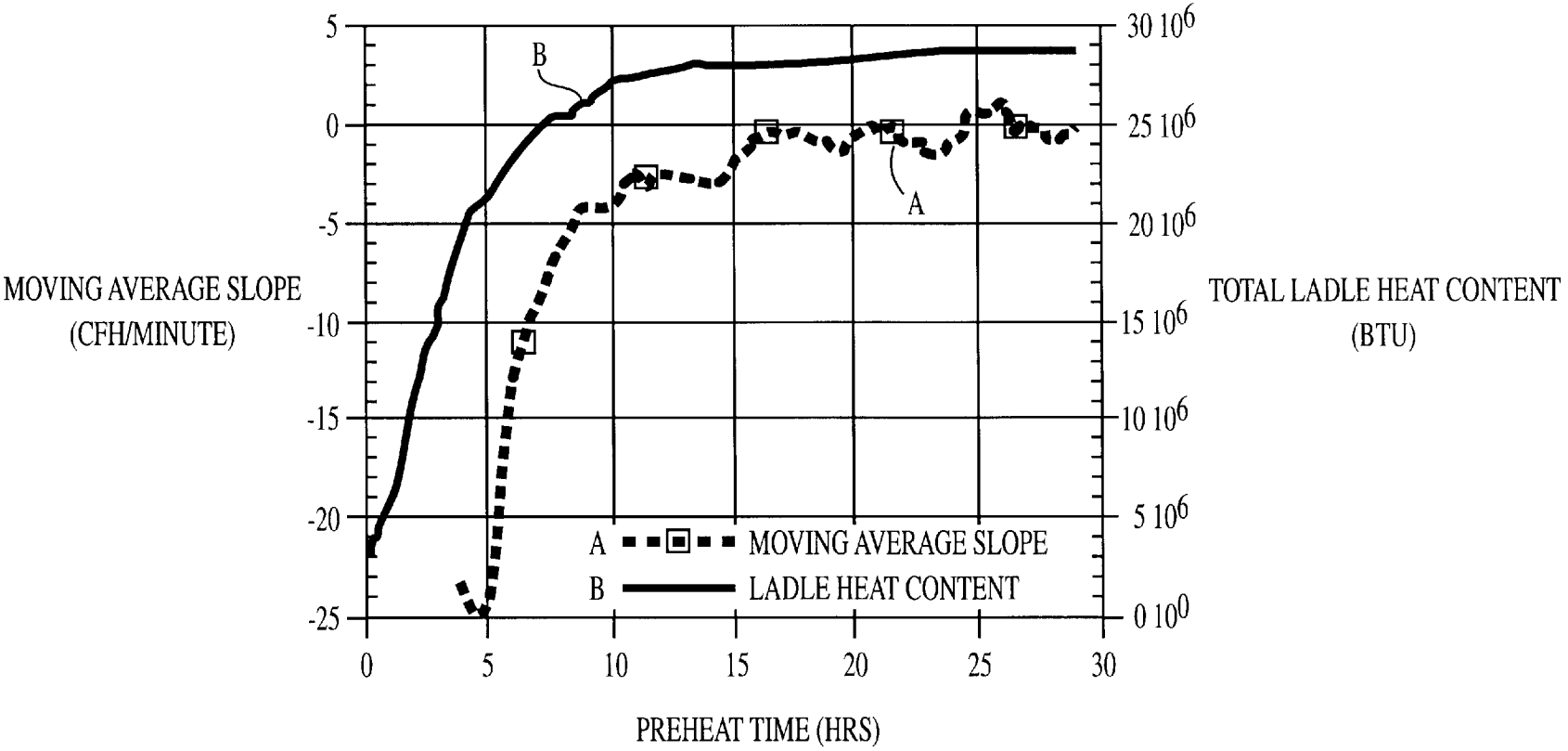
FIG. 4 comprises graphs showing changes with time of the moving average slope (graph A) and the total ladle heat content (graph B)

Equations 4A and 4B are used to recalculate the average slope in each time period i, thus constantly re-estimating the average slope of the changing heat input rate (gas flow rate), which we term the moving average slope. The moving average slope curves of FIGS. 3 and 4 were determined by the average slope of the fuel gas change rate vs. time curve using data collected in 5 minute increments, $x_1$, in a 3-hour period, L, so that, for this case, the units of moving average slope are CFH/5 min. In this case, n=36 and, at each sample point, the new slope was updated based on the prior L period of time.

Moving average slope, estimated from a number of data measurements, always has some variation and is uncertain due also to data limitations. For example, during the preheating time period, control temperature may vary above and below the set point temperature, so that the actual slope of the heat input change curve may be higher or lower than the average slope, resulting in a variance of the slope, i.e. a measure of the probable range of slopes that can be determined from the data. Such variance can be calculated, taking into account such variations in control temperature and consequent gas flow rate to provide a more accurate maximum slope as a function of the moving average slope and the standard deviation of the average slope, thereby providing a safer estimate of the actual rate of change of heat input rate. Thus, a maximum slope, smoothing out the variations in the moving average slope, constituting an upper boundary for the measured rate of change of the refractory heat input rate (the first derivative of the moving average slope) and providing a better estimate of the actual rate of change of the heat input rate, is determined by the following relationship:

Maximum Slope=average slope+$n\sigma$ Equation 5 where:

σ is the standard deviation of the slope, and n is the number of standard deviations.

For example, when n=2, there is a 95% confidence level that the measured rate of change of the refractory heat input rate is equal to or less than that indicated by the maximum slope. Thus, referring, for example, to FIG. 4, a graph of maximum slope plotted against preheating time would be spaced a distance, e.g. equal to 2σ, below the graph A of the moving average slope of that Fig., thus constituting a higher (more negative) boundary for the slope and providing a better reference than the uncorrected moving average slope for monitoring changes in the heat input (or gas flow) rate.

In order to most accurately determine when the heat absorption by the ladle refractories is approaching a steady state, indicating that the heat content of the ladle is approaching the soaked condition and the ladle is ready for service, the second derivative of the maximum slope (a comparison of the maximum slope at a given time within time L to that in a prior time period) is estimated by means of the following relationship:

Estimate of the 2nd derivative = Equation 6

[max. slope (calculated at time $i-L$) − [max. slope (calculated time interval $i$)] / max. slope (calculated at time $i-L$)

where, as in Equations 4A and 4B, i is a time period counter.

In monitoring changing rate of heat input into the ladle, (1) the moving average slope is first calculated according to Equations 4A and 4B; then (2) the variance is calculated and, using the results of calculations (1) and (2), the maximum slope is calculated according to Equation 5. Finally the estimated second derivative is calculated by Equation 6 and serves as the primary reference to determine ladle readiness. An exemplary graph of this second derivative of the maximum slope is shown as graph A in FIG. 5. Equations 4A, 4B, 5 and 6 are programmed into a PLC which performs the respective calculations and, when the estimate of the second derivative falls below a predetermined soak criteria (taking into account, for example, initial ladle condition, ladle heat transfer characteristics and heat capacity), the ladle has reached the soak condition and is ready for service, at which point a suitable signal indicating such readiness is actuated.

Figure 1:
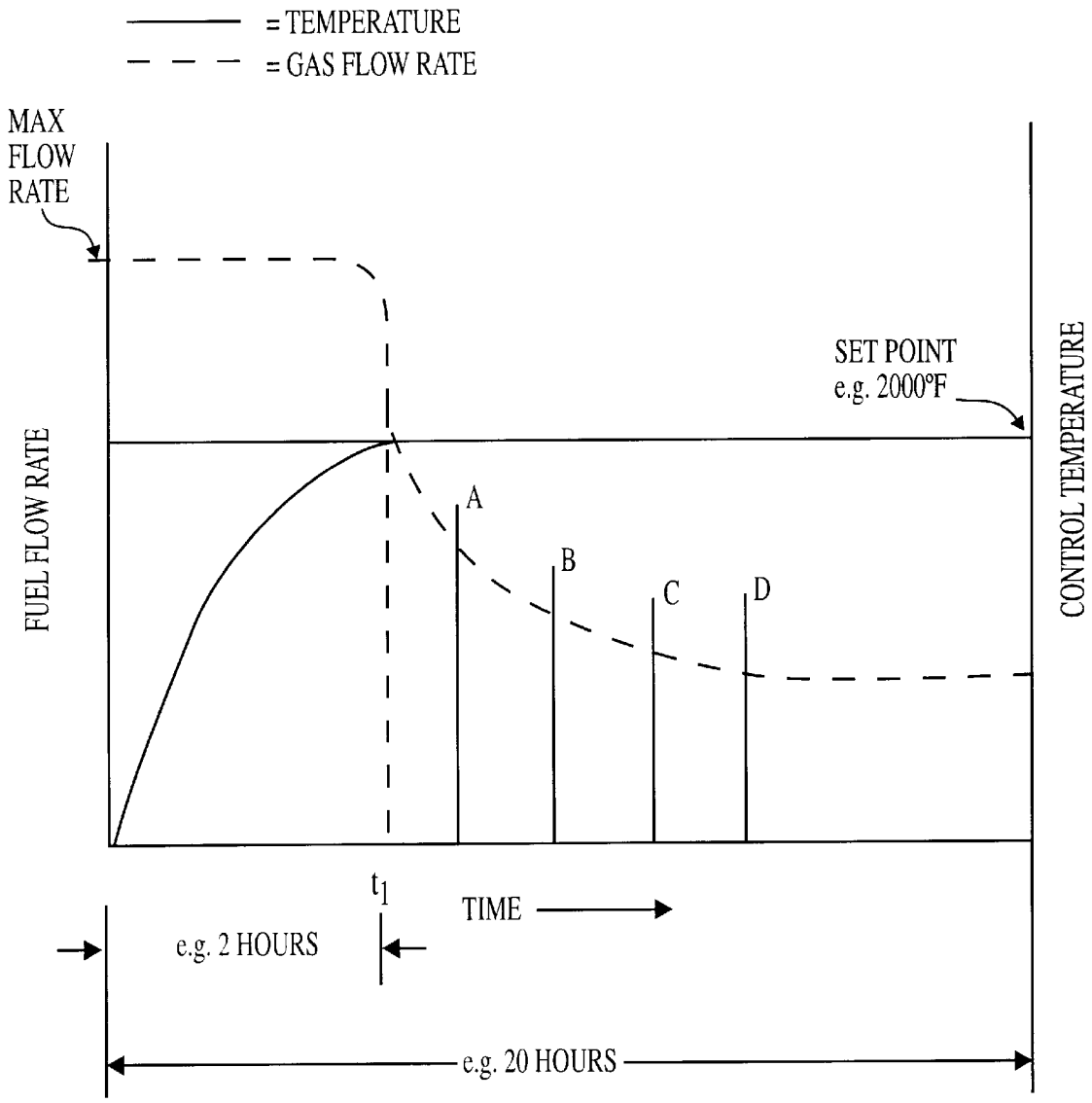
FIG. 1 PRIOR ART
FIG. 1 comprises prior art graphs showing changing rate of fuel flow to a gas-fired preheater burner and control temperature vs. time.
Figure 5:
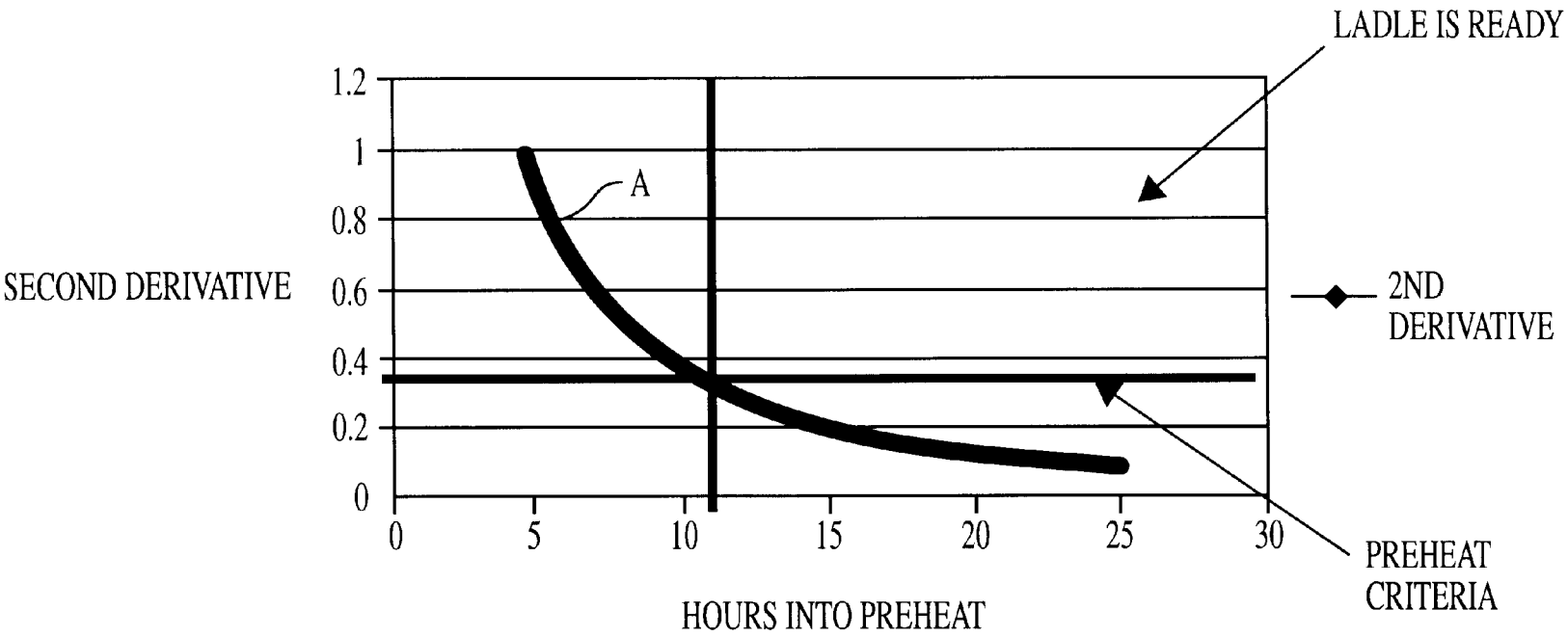
FIG. 5 comprises a graph (A) showing change of the second derivative of the maximum slope with time.

More specifically, tests on preheating of about 50 ladles showed, not only that the rate of heat input followed the rate of change of the gas flow rate as shown in FIG. 1, i.e. that the heat input rate is about equal to the gas flow rate, but also that the rate of decay (decrease) of the heat input rate is exponential so that a graph of the exponential function, $e^t$, vs. unit time during the preheating period is an exponential curve with a negative slope, wherein each increment of unit time is 36% less than the preceeding time unit. Thus, using this relationship, so long as the calculation of the rate of change of the change in heat input rate (second derivative of the maximum slope) is greater than 36% the ladle is not yet soaked and ready for use; only when the value of the second derivative is equal to or lower than 36%, is the ladle soaked and ready. This relationship also is shown in FIG. 5. As will be seen from FIGS. 3 and 4, the moving average slope (or, as above-described, the variation-corrected maximum slope) can be used to provide a good measure of the total ladle heat input. However, the second derivative of the maximum slope, represented by the exponential curve of FIG. 5 which is usable as above-described, provides a still better and easier way to monitor heat content of the ladle and thus to determine when that heat content is sufficient to ready the ladle for service.

Figure 6:
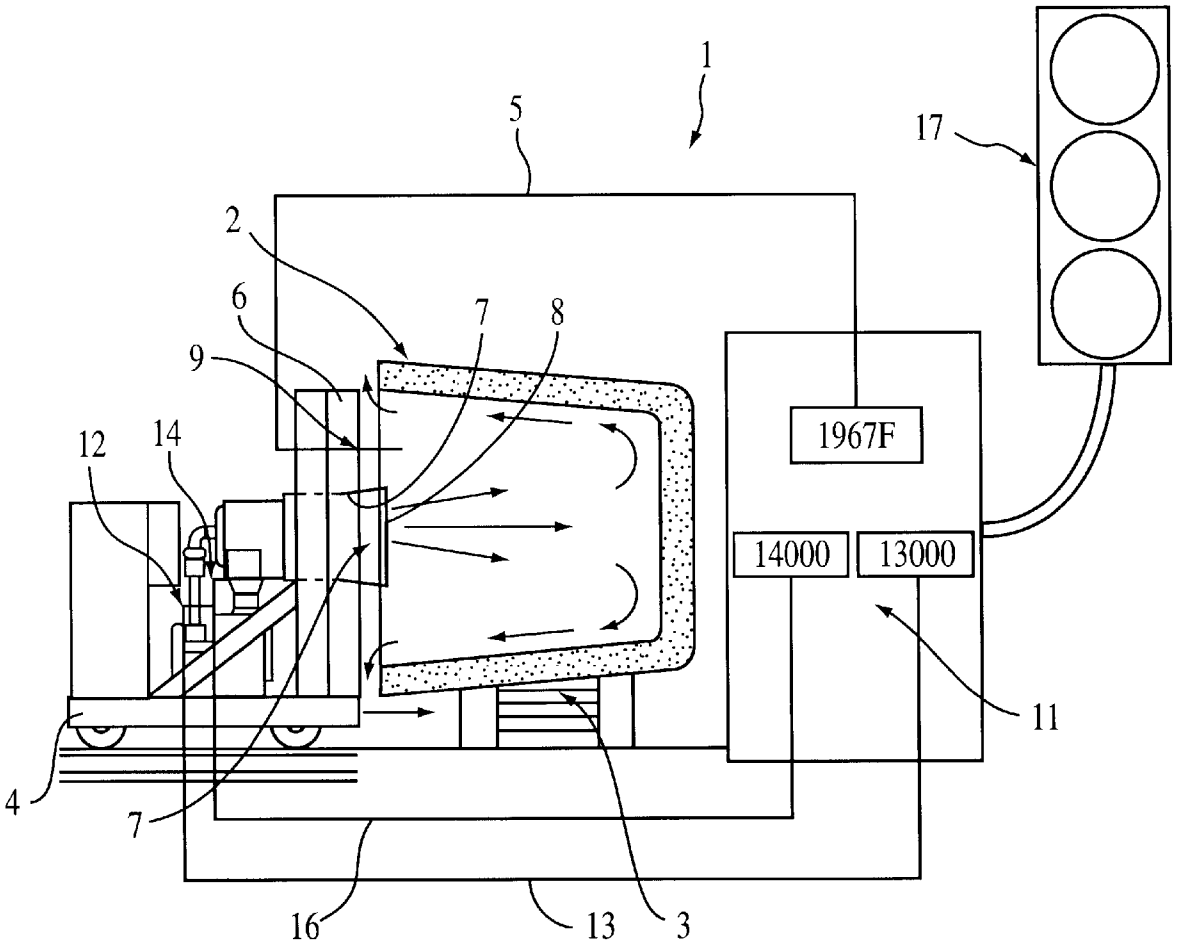
FIG. 6 is a sketch, in side elevation, of the ladle preheater apparatus of the invention.

The apparatus for carrying out the present invention with respect to a fuel gas-fired burner, is illustrated in FIG. 6, in which the numeral 1 generally denotes the preheater apparatus comprising a refractory-lined ladle 2 to be preheated positioned on a horizontal preheating stand 3. Apparatus 1 also comprises a roller-mounted dolly 4 carrying a ladle lid 6 having a central aperture 7 through which a heating flame from a burner 8 is injected into the ladle interior. Lid 6 also is provided with a thermocouple 9 extending through the lid and, in a mounted position of the lid 6 against the ladle 2, extending into the interior of the ladle and connected, by electrical line 5, to a PLC 11 serving as a preheater control panel for inputting a control temperature signal into the PLC which is provided with a set point signal generating capability (indicated by the temperature 1967° F. in the drawing) and with the capability of comparing the control temperature and the set point temperature, as will be more fully explained below.

Burner 8 is supplied with a fuel gas, such as natural gas, from a gas flow meter 12 connected to a gas supply source (not shown) and, through electrical line 13, to the PLC 11 for inputting a gas flow rate signal to the PLC (indicated in FIG. 6 by the rate 13,000 cubic feet per hour (CFR). Burner 8 also is supplied with combustion air from an air flow meter 14 connected to an air supply source (not shown) and, through electrical line 16, to the PLC 11 for inputting an air flow rate signal to the PLC (indicated in FIG. 6 by the rate 14,000 CFR). The PLC 11 also is connected to, for example, a visual preheat indicator signal 17 which, on actuation by the PLC, indicates to the operator when the ladle is fully soaked and ready for service.

Figure 7:
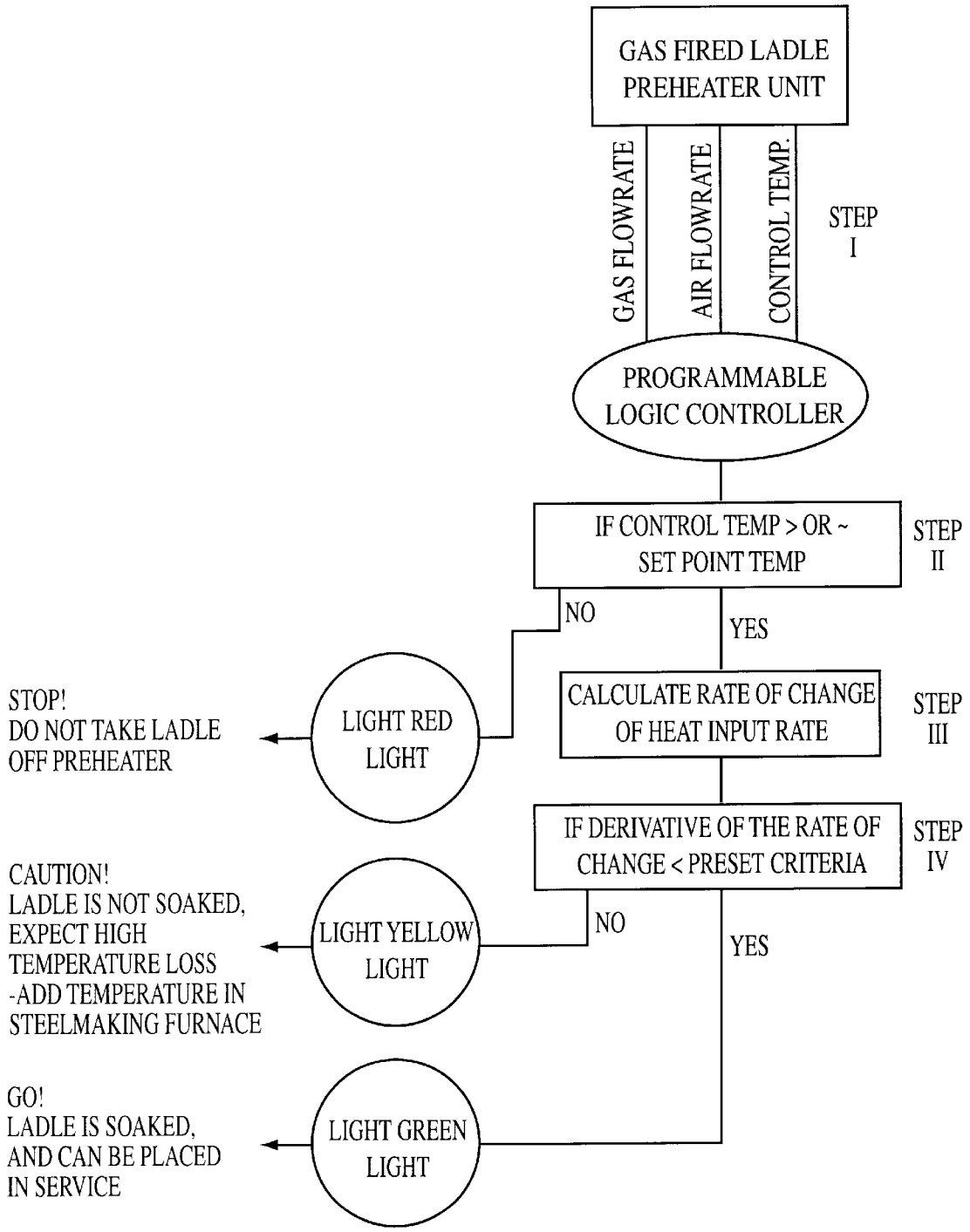
FIG. 7 is a block diagram showing the several steps involved in monitoring, during ladle preheating, of the ladle refractory heat content in accordance with this invention.

In operation of the method and apparatus of this invention, as shown in the block diagram of FIG. 7, a first step, for a gas-fired preheater, is to input fuel gas flow rate, air flow rate and control temperature, along with a desired set point temperature, into the PLC (Step I). The PLC performs a logical comparison between the control temperature and the set point temperature (Step II). If the control temperature is above or close to the set point temperature, then the PLC will change the indicator lights 17, shown in FIG. 6, from Red to Yellow indicating that the ladle is not fully soaked so that there would be substantial loss of heat on introducing molten steel into the ladle at this point and which would require raising the temperature of the molten steel in the steelmaking furnace. At such time, the PLC begins to calculate the heat input rate to the ladle refractory (a function of fuel gas flow rate, air flow rate and control temperature). Then the PLC calculates the rate of change of the heat input rate (Step III) and, after a period of time, the approximate second derivative of the heat input rate, i.e. how the rate of change of the heat input rate changes over time (Step IV). If the second derivative of the heat input rate is less than a predetermined value (which, as above noted, takes into account factors such as the initial ladle temperature, ladle heat transfer characteristics and the total heat capacity of the ladle) which is equal to or less than 36% (see FIG. 5), then the PLC will change the indicator light from yellow to green, indicating that the ladle is fully soaked and ready for service.

The foregoing description has been set forth in the context of a ladle preheater which is heated by a gas, e.g. natural gas, fired burner. The invention also is applicable to electrically heated preheaters, in which case the rate of heat input and changes therein are based upon the electrical power supplied to the preheater.

What is claimed is:

1. A method for preheating a refractory-lined ladle, comprising measuring ladle refractory temperature to establish a control temperature, predetermining a ladle set point temperature to which the ladle is to be heated, comparing the control temperature and the set point temperature to control heat input rate to the ladle, calculating an average slope of heat input vs. time and representing the rate of change of heat input rate into the ladle, and using the calculated average slope to monitor the heat content of the ladle and to determine when the ladle refractory is fully heated throughout and ready for service.

2. A method of preheating a refractory-lined ladle for receipt and transport of molten metal, comprising generating data representing a measured actual control temperature of the ladle refractory hot face and a desired set point temperature to which the ladle refractory is to be heated, inputting said data into a PLC and therein performing a logical comparison between the control temperature and the set point temperature to control the rate of heat input into the ladle, calculating a moving average slope representing the rate of change of heat input rate into the ladle and, when the change with time of the moving average slope is substantially zero, generating an appropriate signal indicating that the ladle refractory is fully heated and the ladle is ready for service.

3. A method according to claim 2, which comprises determining the moving average slope, CFH/fractional time period, in accordance with the relationship:

$$\frac{n\sum_{i=1}^{n} x_i y_i - \sum_{i=1}^{n} x_i \sum_{i=1}^{n} y_i}{n\sum_{i=1}^{n} x_i^2 - \sum_{i=1}^{n} x_i^2}$$

and $$L = \sum_{i=1}^{n} x_i.$$

4. A method according to claim 3, further comprising enhancing the accuracy of the moving average slope calculation by calculating a maximum slope of heat input rate vs. time in accordance with the relationship:

$$\text{maximum slope} = \text{average slope} + n\sigma.$$

and using change of the maximum slope to monitor ladle heat content to determine when the ladle refractories are fully soaked and ready for service.

5. A method according to claim 4, wherein n is 2 and, with a 96% confidence level, the measured rate of change of the heat input rate to the ladle refractory is equal to or less than that indicated by the maximum slope.

6. A method according to claim 5, further comprising calculating the second derivative of the maximum slope and, when the second derivative is less than a preset level indicating little or no change in the value of the second derivative, generating a signal indicating that the ladle is fully preheated throughout the refractory thickness and the ladle is ready for service.

7. A method according to claim 6, comprising estimating the second derivative by the formula:

$$\text{Estimate of the 2nd derivative} = [\text{max. slope (calculated at time } i-L) - [\text{max. slope (calculated time interval } i)] / \text{max. slope (calculated at time } i-L)$$

providing a negative slope exponential relationship between the exponential function, $e^t$, and time and using the second derivative to monitor change over time of the rate of heat input to the ladle.

8. A method according to claim 7, further comprising continuously calculating the second derivative and, as long as the value of the exponential function, $e^t$, is greater than 36%, generating a signal indicating that the ladle refractory is not yet soaked and, when the value of the second derivative is equal to or lower than 36%, generating a signal indicating that the ladle is soaked and ready for use.

9. A method according to claim 3, further comprising correcting the moving average slope for unavoidable variations in control temperature and heat input rate in accordance with the following relationship:

$$\text{maximum slope} = \text{average slope} + n\sigma$$

whereby the maximum slope constitutes an upper boundary improving the accuracy of the moving average slope in determining when the ladle is fully soaked and ready for service.

10. A method according to claim 9, further comprising determining when the change over time of the rate of heat input to the ladle refractory falls to a level indicating that the ladle is approaching a fully soaked condition by estimating the second derivative of the maximum slope according to the following relationship:

$$\text{Estimate of the 2nd derivative} = [\text{max. slope (calculated at time } i-L) - [\text{max. slope (calculated time interval } i)] / \text{max. slope (calculated at time } i-L)$$

continuing the preheating as long as the value of the second derivative is equal to or greater than 36%, and signaling the readiness of the ladle for service when the value of the second derivative is less than 36%.

11. A method of determining when a refractory-lined ladle being preheated is fully soaked and ready for service, comprising calculating an average slope representing change over time of the rate of change of heat input into the ladle, and signaling the readiness of the ladle when there is substantially no change in the average slope.

12. A method according to claim 11, further comprising correcting the average slope for unavoidable variations in the preheating process to provide a $$\text{maximum slope} = \text{average slope} + n\sigma$$

where:

$\sigma$ is the standard deviation of the slope, and n is the number of standard deviations, and signaling a termination of preheating when change in the maximum slope is substantially zero.

13. A method according to claim 12, further comprising calculating the second derivative of the maximum slope, and signaling a termination of preheating when the value of the second derivative is equal to or less than 36%.

14. A method of indicating preheat condition of a refractory-lined ladle, comprising controlling the rate of heat input into the ladle in accordance with an actual ladle control temperature and a set point temperature to which the ladle is to be preheated, reducing the rate of heat input after the control temperature reaches the set point temperature, calculating a moving average slope representing change over time of the rate of change of heat input, calculating the second derivative of the heat input rate based on the moving average slope, monitoring change of the second derivative, and terminating ladle preheating when the second derivative falls below preset criteria indicating a fully preheated ladle.

15. A method according to claim 14, wherein the preset criteria is a second derivative value, plotted against ladle preheating time, equal to or less than 36%.

16. A ladle preheat indication system, comprising a refractory-lined ladle to be preheated before introduction of liquid metal into the ladle, means to input heat energy into the interior of the ladle, means to control the rate of heat input into the ladle, means to measure actual control temperature of a ladle refractory surface, PLC means to receive a predetermined set point temperature to which the ladle refractory is to be heated, means to input into the PLC a first signal representing the rate of energy input into the ladle and a second signal representing the control temperature, means programmed into the PLC to compare the control temperature and the set point temperature and, when the control temperature is equal to or greater than the set point temperature, to calculate the second derivative of the heat energy input rate, and means to actuate a signal when the calculated value of the second derivative falls below preset criteria, indicating that the ladle refractory is fully preheated and the ladle is ready for service.

17. A system according to claim 16, wherein the preset criteria is a second derivative value, plotted against ladle preheating time, equal to or less than 36%.

18. A ladle preheating system, comprising means to control the rate of heat input into the ladle in accordance with an actual ladle control temperature and a set point temperature to which the ladle is to be preheated, means to reduce the rate of heat input after the control temperature reaches the set point temperature, means thereafter to calculate (a) a maximum average slope representing change over time of the rate of change of heat input and (b) based on the maximum average slope, the second derivative of the heat input rate, means to monitor change of the second derivative and to signal a fully preheated ladle when the second derivative falls below preset criteria.

19. A system according to claim 18, wherein the preset criteria is a second derivative value, plotted against preheat time, equal to or less than 36%.

* * * * *